United States Patent [19]

Begley

[11] Patent Number: 4,533,302

[45] Date of Patent: Aug. 6, 1985

[54] GEROTOR MOTOR AND IMPROVED LUBRICATION FLOW CIRCUIT THEREFOR

[75] Inventor: Benjamin D. Begley, Shawnee, Okla.

[73] Assignee: Eaton Corporation, Cleveland, Ohio

[21] Appl. No.: 581,487

[22] Filed: Feb. 17, 1984

[51] Int. Cl.[3] ..... F03C 2/08

[52] U.S. Cl. ..... 418/61 B; 418/102

[58] Field of Search ..... 418/61 B, 102

[56] References Cited

U.S. PATENT DOCUMENTS

| | | | |
|---|---|---|---|
| 3,680,987 | 8/1972 | Ohrberg | 418/61 B |
| 3,862,814 | 1/1975 | Swedberg | 418/102 |
| 3,869,228 | 3/1975 | Swedberg | 418/132 |
| 3,905,728 | 9/1975 | Swedberg | 418/61 B |
| 4,343,600 | 8/1982 | Thorson | 418/61 B |
| 4,432,710 | 2/1984 | Hansen et al. | 418/61 B |

*Primary Examiner*—John J. Vrablik
*Assistant Examiner*—Theodore Olds
*Attorney, Agent, or Firm*—C. H. Grace; L. J. Kasper

[57] ABSTRACT

A rotary fluid pressure device is disclosed of the type including a roller gerotor (17) having a ring member (23) and a plurality of rollers (25) serving as internal teeth. At each end of each roller (25) is a side clearance space (85) and a small amount of lubrication fluid flows from each pressurized volume chamber through the side clearance spaces (85) into an adjacent lubricant recess (81). All of the lubricant recesses (81) are in communication with the fluid-collecting groove (79) and lubrication fluid flows from the groove (79) to the motor lubrication flow path. The lubrication flow path includes flow through a rearward bearing set (35); a forward bearing set (33); a pair of fluid passages (36); the forward splines (37, 39); and the rearward splines (43, 45). The invention results in improved lubrication generally, and of the forward splines in particular. The invention also improves the load-holding capability of the motor and biases the valve drive shaft (49) to its rearward position to reduce wear of the internal spline (53) of the rotary valve member (55).

19 Claims, 5 Drawing Figures

GEROTOR MOTOR AND IMPROVED LUBRICATION FLOW CIRCUIT THEREFOR

BACKGROUND OF THE DISCLOSURE

The present invention relates to rotary fluid pressure devices such as low-speed, high torque gerotor motors, and more particularly, to an improved lubrication flow circuit therefor.

A typical motor of the type to which the present invention relates includes a housing defining inlet and outlet ports and some type of fluid energy-translating displacement mechanism such as a gerotor gear set. The motor further includes valve means to provide fluid communication between the ports and the volume chambers of the displacement mechanism.

Although the present invention may be used advantageously in combination with various types of displacement mechanisms, it is especially advantageous when used in a device including a gerotor gear set, and will be described in connection therewith. The invention is even more advantageous when the gerotor gear set is of the roller gerotor type, and will be described in connection therewith.

In gerotor motors of the type to which the invention relates, an externally-splined main drive shaft (dogbone) is typically used to transmit motion from the orbiting and rotating gerotor star to the rotating output shaft. In order for the motor to have adequate operating life, it is important that these torque transmitting spline connections be lubricated by a flow of hydraulic fluid. It is also important that certain other elements of the motor be lubricated, such as any shaft bearing, etc.

In prior art motors of the type to which this invention relates, it has been known to provide a controlled amount of lubrication flow by means of one or more metering notches defined by the rotary valve member, between the high and low pressure sides. See for example U.S. Pat. No. 3,572,983, assigned to the assignee of the present invention. This lubrication flow (typically about 0.5 gpm) flows toward the output shaft end of the motor, through the dogbone spline connections, then through any bearings which support the output shaft relative to the housing. See U.S. Pat. No. 3,862,814, assigned to the assignee of the present invention and incorporated herein by reference.

For a number of years prior to the present invention, the above-described lubrication arrangement was considered the best available arrangement, although certain problems existed. In the prior art arrangement, the lubricating fluid has already lubricated the splines of the valve drive shaft and the rear dogbone spline connection before it reaches the forward dogbone spline connection, which has been found to be the most critical portion of the motor in terms of lubrication requirements. In addition, diverting a certain amount of high-pressure fluid from the valve area to serve as lubricating fluid reduces the volumetric efficiency of the motor. If the pressure of the lubricating fluid flowing through the case drain region of the motor is higher than the pressure of fluid flowing to the outlet port, some portion of the intended lubrication fluid will bypass the case drain region and flow directly to the outlet port, thus resulting in inconsistent lubrication flow.

SUMMARY OF THE INVENTION

Accordingly, it is an object of the present invention to provide a rotary fluid pressure device having an improved lubrication flow circuit, and especially, having improved lubrication of the main torque transmitting drive connections (dogbone splines) to improve the life and durability of the motor.

The above and other objects of the present invention are accomplished by the provision of an improved rotary fluid pressure device of the type including housing means defining fluid inlet means and fluid outlet means. A fluid energy-translating displacement mechanism is associated with the housing means and includes an internally-toothed member and an externally-toothed member, eccentrically disposed within the internally-toothed member for relative orbital and rotational movement therebetween. The teeth of the members interengage to define expanding and contracting fluid volume chambers during the relative movement, one of the members having rotational movement about its own axis, and one of the members having orbital movement about the axis of the other member. Valve means provides fluid communication between the fluid inlet means and the expanding volume chambers and between the contracting volume chambers and the fluid outlet means. The device includes input-output shaft means and bearing means disposed radially between the shaft means and the housing means to support the shaft means for rotation relative to the housing means. A main drive shaft means is operable to transmit rotational movement between one of the tooth members and the input-output shaft means. The main drive shaft means cooperates with the one of the toothed members having rotational movement to define first torque transmitting drive means. The main drive shaft means cooperates with the input-output shaft means to define second torque transmitting drive means. The device includes means defining a lubrication flow path including the first and second torque transmitting drive means and the bearing means.

The improved device is characterized by:

(a) the fluid energy-translating displacement mechanism including means providing a generally continuous flow of lubrication fluid from at least a portion of said fluid volume chambers to said lubrication flow path;

(b) the lubrication flow path comprising, in the order indicated:

(i) flow through the bearing means;

(ii) flow through the second torque transmitting connection means; and (iii) flow through the first torque transmitting connection means; and (c) the fluid pressure device defining drain passage means communicating the flow of lubrication fluid from the lubrication flow path to either the low-pressure fluid outlet means or a separate case drain outlet port.

DESCRIPTION OF THE PREFERRED EMBODIMENT

Figure 1:
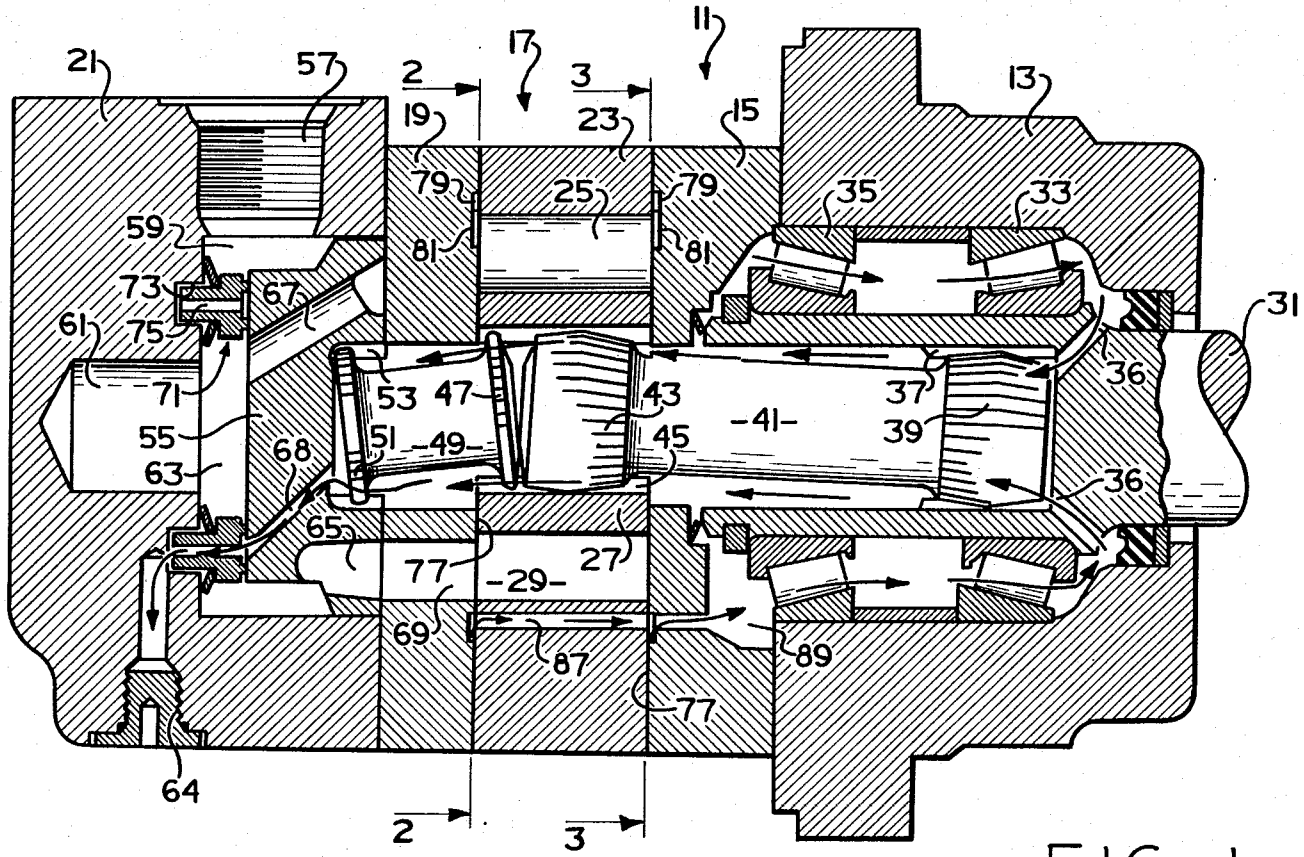
FIG. 1 is an axial cross section of a low-speed, high-torque gerotor motor utilizing the improved lubrication flow circuit of the present invention.

Referring now to the drawings, which are not intended to limit the invention, FIG. 1 illustrates a low-speed, high-torque gerotor motor of the type to which the present invention may be applied, and which is illustrated and described in greater detail in U.S. Pat. Nos. 3,572,983 and 4,343,600, both of which are assigned to the assignee of the present invention and are incorporated herein by reference.

The hydraulic motor shown in FIG. 1 comprises a plurality of sections secured together, such as by a plurality of bolts (not shown). The motor, generally designated 11, includes a shaft support casing 13, a wear plate 15, a gerotor displacement mechanism 17, a port plate 19, and a valve housing portion 21.

The gerotor displacement mechanism 17 (see also FIG. 2) is well known in the art, is shown and described in great detail in the incorporated patents, and will be described only briefly herein. More specifically, the displacement mechanism 17 is a roller gerotor comprising an internally-toothed ring 23 defining a plurality of generally semi-cylindrical pockets or openings, with a cylindrical roller member 25 disposed in each of the openings. Eccentrically disposed within the ring 23 is an externally-toothed star 27, typically having one less external tooth than the number of cylindrical rollers 25, thus permitting the star 27 to orbit and rotate relative to the ring 23. The relative orbital and rotational movement between the ring 23 and star 27 defines a plurality of expanding and contracting volume chambers 29.

Referring again to FIG. 1, the motor includes an output shaft 31 positioned within the shaft support casing 13 and rotatably supported therein by suitable bearing sets 33 and 35. The shaft 31 defines a pair of angled fluid passages 36 which will be referenced subsequently in connection with the lubrication flow circuit of the invention. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight splines 45, formed on the inside diameter of the star 27. Therefore, in the subject embodiment, because the ring 23 includes seven internal teeth 25, and the star 27 includes six external teeth, six orbits of the star 27 result in one complete rotation thereof, and one complete rotation of the main drive shaft 41 and the output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21. The valve drive shaft 49 is splined to both the star 27 and the valve member 55 in order to maintain proper valve timing therebetween, as is generally well known in the art.

The valve housing 21 includes a fluid port 57 in communication with an annular chamber 59 which surrounds the valve member 55. The valve housing 21 also includes an outlet port 61 which is in fluid communication with a chamber 63 disposed between the valve housing 21 and valve member 55, and a case drain port 64 which, in FIG. 1, is plugged to force the case drain fluid to flow to whichever port 57 or 61 is at return pressure. The valve member 55 defines a plurality of alternating valve passages 65 and 67, the passages 65 being in continuous fluid communication with the annular chamber 59, and the passages 67 being in continuous fluid communication with the chamber 63. In the subject embodiment, there are six of the passages 65, and six of the passages 67, corresponding to the six external teeth of the star 27. The valve member 55 also defines an angled drain passage 68 which will be discussed further subsequently. The port plate 19 defines a plurality of fluid passages 69 (only one of which is shown in FIG. 1), each of which is disposed to be in continuous fluid communication with the adjacent volume chamber 29.

As is well known to those skilled in the art, it is necessary to maintain the valve member 55 in sealing engagement with the adjacent surface of the port plate 19, to prevent cross port leakage between the fluid chambers 59 and 63. To effect such sealing, a valve seating mechanism 71 is included, seated within an annular groove 73 defined by the valve housing 21. The valve seating mechanism 71 is well known in the art, see previously cited U.S. Pat. No. 3,572,983, and will not be described in detail herein. It should be noted, however, that the mechanism 71 defines a plurality of axial drain bores 75, which will be discussed subsequently.

The general operation of the low-speed, high-torque gerotor motor shown in FIG. 1 is also well known to those skilled in the art and is described in detail in the above-incorporated patents. For purposes of this description, it is sufficient to note that, for example, high-pressure fluid may be communicated to the inlet port 57, and from there will flow through the chamber 59, the valve passages 65, the fluid passages 69, and enter the expanding volume chambers 29 causing the rotor 27 to orbit and rotate. The orbital and rotational movement of the rotor 27 will be transmitted by means of the main shaft 41 to the output shaft 31, causing rotation thereof. As the rotor 27 orbits and rotates, low-pressure fluid is exhausted from the contracting volume chambers 29 and is communicated through the respective fluid passages 69 and valve passages 67 to the fluid chamber 63, and then out the fluid port 61.

Figure 3:
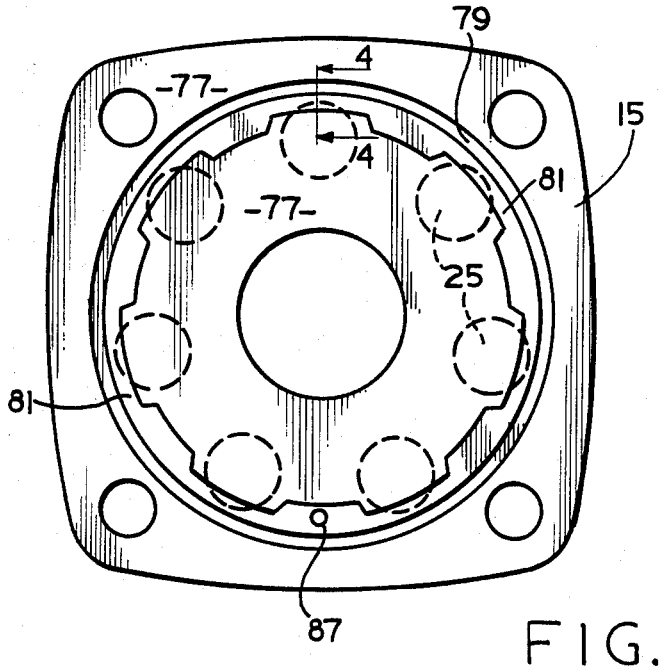
FIG. 3 is a transverse cross section, taken on line 3—3 of FIG. 1, and on the same scale as FIG. 2, showing only the wear plate with the gerotor rollers superimposed in dashed lines.
Figure 4:
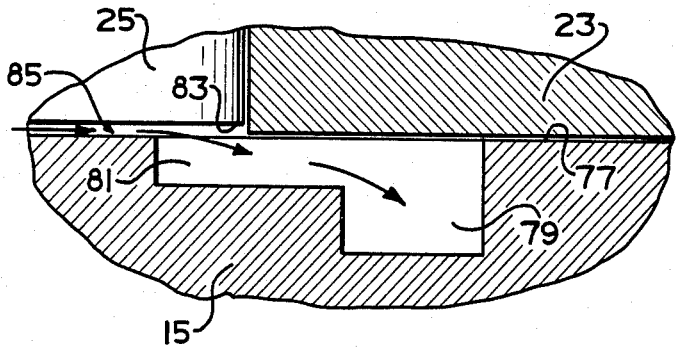
FIG. 4 PRIOR ART
FIG. 4 is an enlarged, fragmentary, axial cross section taken on line 4—4 of FIG. 3 illustrating the side clearance spaces and lubricant recesses of the present invention.

Referring now primarily to FIGS. 3 and 4, it may be seen that the wear plate 15 defines an axial end surface 77, in engagement with an adjacent end surface of the ring 23 and star 27. In FIG. 3, each of the gerotor rollers 25 is illustrated by means of a dashed-line circle, merely to illustrate the positions of the rollers 25, relative to the end surface 77.

Disposed radially outwardly of the rollers 25 is an annular fluid-collecting groove 79, which may also serve as a seal-ring or O-ring groove. It should be noted in FIG. 3 that the reference numeral 77 is also used to refer to the surface of the wear plate 15 radially outwardly from the groove 79, primarily to indicate that the two end surface areas bearing the reference numeral 77 are substantially coplaner. However, all further reference to the end surface 77 will refer to the portion inside the groove 79.

Disposed radially between the axial end surface 77 and the fluid-collecting groove 79 is a plurality of lubricant recesses 81 which are disposed, circumferentially, immediately adjacent the radially outermost portion of each of the rollers 25, and in open fluid communication with the groove 79 as shown in FIG. 4. Within the scope of the invention, each of the lubricant recesses 81 adjacent each of the rollers 25 may be separate, but in the Preferred Embodiment, as shown in FIG. 3, all of the recesses 81 are joined together to form one continuous annular recess.

Figure 5:
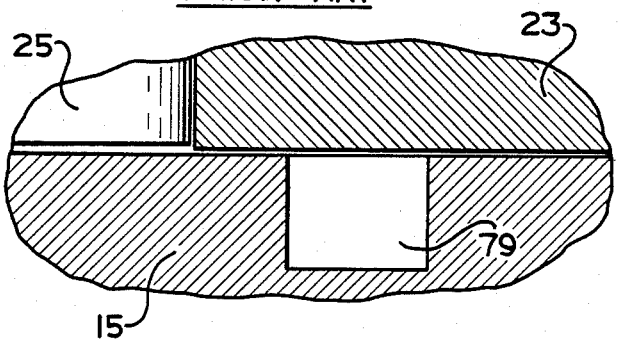
FIG. 5 is a view similar to FIG. 4 illustrating the "PRIOR ART" structure.

As may best be seen in FIG. 4, each of the rollers 25 has an axial end surface 83, and because the axial length of each of the rollers 25 is slightly less than the axial length of the ring member 23, each axial end surface 83 will cooperate with the axial end surface 77 of the wear plate 15 to define a side clearance space 85. It may be seen by reference to the PRIOR ART of FIG. 5 that, prior to the present invention, any fluid in the side clearance space 85 would be substantially prevented from flowing to the groove 79 by the sealing engagement of the end surface of the ring member 23 against the end surface 77. The spacing shown therebetween in FIGS. 4 and 5 is shown only for ease of illustration of the parts and does not actually exist.

As will be apparent to those skilled in the art, it is preferable that the arrangement illustrated in FIG. 4 be duplicated on the opposite axial end of the gerotor set 17, partly to maintain hydraulic balance of each of the rollers 25, i.e., balance in the axial direction. In other words, it is necessary that the port plate 19 includes certain of the elements shown in the FIG. 3 view of the wear plate 15, including: the axial end surface 77; the fluid-collecting groove 79; and the plurality of lubricant recesses 81. Therefore, because the drawings of the present invention, at the opposite end of the gerotor set, would substantially duplicate FIGS. 3 and 4, such drawings will not be included herein in detail. However, it should be noted that in FIG. 1, the elements noted above (77, 79, and 81) are illustrated at both ends of the gerotor set 17. Furthermore, the opposite fluid-collecting grooves 79 are interconnected by means of an axial bore 87, defined by the ring member 23.

OPERATION

Figure 2:
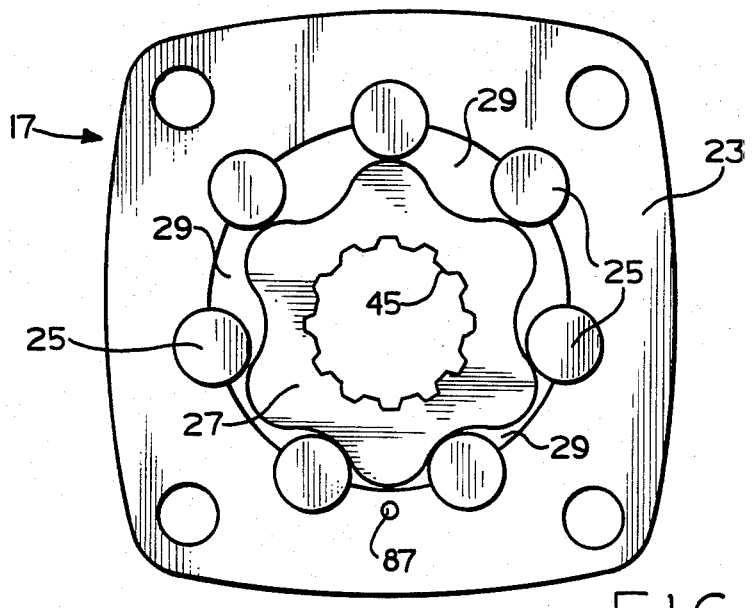
FIG. 2 is a transverse cross section, taken on line 2—2 of FIG. 1, and on approximately the same scale, showing only the roller gerotor gear set.

The general operation of the fluid motor 11 has already been described and will not be repeated herein. During such operation, certain of the fluid volume chambers 29 are pressurized and expanding, while certain others are contracting and contain fluid at approximately return pressure (approximately reservoir pressure). Referring to FIG. 2, assuming orbital movement of the star 27 in a clockwise direction, and rotation thereof in the counterclockwise direction, those skilled in the art will recognize that the three right-hand volume chambers 29 are pressurized while the three left-hand volume chambers are at return pressure.

Utilizing the present invention, at each of the rollers 25 which is instantaneously disposed adjacent a pressurized volume chamber, fluid flows through the side clearance spaces 85 defined at each end of that particular roller 25. The cumulative flow of fluid through several of the side clearance spaces 85 comprises the flow of lubrication fluid. The flow from each of the side clearance spaces 85 enters the adjacent lubricant recess 81, then each of these individual flows combine in the groove 79. As described previously, the same arrangement shown in FIG. 4 with regard to wear plate 15 is duplicated at the opposite end of the gerotor set, i.e., at the port plate 19. Therefore, lubricant flow which enters the groove 79 defined by the port plate 19 flows through the axial bore 87 and combines with the lubricant flow collected in the groove 79 which is defined by the wear plate 15. These two sources of lubricant fluid combine to form a single, relatively constant flow of lubrication fluid. This flow of lubrication fluid is directed to the lubrication flow path of the motor which will now be described.

The lubrication fluid which flows from the pressurized volume chambers 29, as described previously, flows into a central cavity 89, which may be considered the beginning of the lubrication flow path through the motor. From the cavity 89, lubricant flows toward the right in FIG. 1, through the bearing sets 35 and 33 in that order, and in series. As indicated by the arrows in FIG. 1, the lubricant then flows through the angled fluid passages 36 defined by the shaft 31 to the interior of the hollow cylindrical portion of the shaft 31. After the lubricant flows through the passages 36, it then flows through the splines 37 and 39 (to the left in FIG. 1) to provide lubrication of that portion of the motor which is generally the most critical, in terms of the need for lubrication, as was mentioned in the background of this specification. As is generally well known to those skilled in the art, it is when the lubricant flows through torque-transmitting elements, such as splines, that the lubricant is subjected to the greatest temperature increase (and corresponding loss of lubricity), and is most likely to pick up contamination particles, such as small metallic particles from splines. Therefore, it is one important aspect of the lubrication circuit of the present invention that relatively fresh, cool lubricant is directed first to the splines 37 and 39, rather than flowing through the splines 37 and 39 only after having already lubricated several other spline connections as in the prior art.

Referring still to FIG. 1, after the lubricant flows through the splines 37 and 39, it continues to flow to the left in FIG. 1 along the length of the main drive shaft 41, then through the splines 43 and 45, which are generally considered to present the second most critical lubrication requirement. After flowing through the splines 43 and 45, the lubricant flows through the splines 47 of the valve drive shaft 49, then through the splines 51 and 53 of the valve drive shaft and valve member 55, respectively. By the time the lubricant reaches the splines of the valve drive shaft 49, it will normally have been subjected to substantial increase in temperature, and possibly also some contamination. However, in motors of the type shown in FIG. 1, the splines 45 and 47 and the splines 51 and 53 are not really torque transmitting splines, but instead, as mentioned previously, are required merely to keep the valve member 55 rotating in synchronism with the rotation of the star 27. Therefore, the lubrication requirements of the splines 47 and 51 are only minimal, and having the splines of the valve drive shaft toward the end of the lubrication flow path is an ideal situation.

It has also been found during the development of the present invention that the lubrication flow path flowing in the direction indicated by the arrows in FIG. 1 achieves a very substantial but unexpected result. With the lubrication fluid flowing to the left in FIG. 1, it has been found that the flow tends to keep the valve drive shaft 49 biased to its extreme leftward position, against the adjacent surface of the rotary valve member 55, as shown in FIG. 1. As a result, because the splines 53 are normally stronger toward the left end thereof, it has been observed that the lubrication flow circuit of the present invention substantially reduces wear of the internal splines 53. This is an important result because any wear of the splines 53 causes a loose spline fit, and loose connection between the shaft 49 and valve member 55, thus causing mistiming of the valving and generally poor performance of the motor.

Referring still to FIG. 1, after the lubricant flows through the splines 51 and 53, it next flows through the angled drain passage 68, defined by the valve member 55, then through the axial drain bores 75 defined by the valve seating mechanism 71. At this point, the lubricant flow has completed its task of lubricating the motor and is now ready to be exhausted from the motor, such as from the case drain port 64 or, if the port 64 is plugged as in FIG. 1, the lubricant flow may be exhausted through the outlet port 61 to the system reservoir. The selection between these two alternatives can easily be made by one skilled in the art, and is outside the scope of the present invention.

It has been found that the use of the lubrication flow circuit of the present invention improves the volumetric efficiency of the motor. As described in the background of this specification, the prior art devices took lubrication fluid directly from the area of the motor valving and used it Cfor lubrication purposes, before that particular fluid ever had the opportunity to perform any useful work. However, in the present invention, substantially all pressurized fluid entering the motor flows into one of the high-pressure volume chambers 29 and leaves the volume chamber through the respective side clearance space 85 to serve as lubrication fluid only after it has performed some measure of useful work in that particular expanding volume chamber.

Another important characteristic of the motor which has been improved by the present invention is the "load-holding" capability of the motor. When, for example, the motor is used to drive a winch and raise a load, it is important that the motor be able to hold the load if the flow of fluid to the motor is discontinued by the operator, and the motor ports are effectively "blocked." It has been found, during the development of the present invention, that a motor of the type shown in FIG. 1, including the lubrication flow circuit of the invention, has a substantially improved load-holding capability. As used herein, the term "load-holding capability" is measured by the rate of rotation of the output shaft 31 (in the direction of load lowering) with the ports 57 and 61 blocked, and a predetermined load applied to the shaft 31. Two motors of each of two different displacements were tested, and for each displacement, one motor having the lubrication circuit of the invention, and the other being identical except for the use of the prior art lubrication circuit. For the two motors having the smaller displacement, the motor including the invention took three times longer for the output shaft to turn one revolution than the motor without the invention. For the larger displacement, the motor with the invention took 2.5 times longer to turn one revolution than the motor without the invention.

Although the reasons for the improved load-holding capability resulting from the use of the present invention may not be totally understood, it is believed that the improvement is due at least in part to the difference in the flow characteristics of the side clearances 85, as compared to the prior art metering notch in the rotary valve 55. It is believed that under "load-holding" conditions, the several side clearances 85 in communication with the volume chambers which would normally be expanding provide greater cumulative restriction to flow than does the prior art metering notch. In addition, it is believed to be significant that the fluid leaking from each of the volume chambers through the spaces 85 first performs some useful work in resisting reverse rotation of the star 27, whereas, under the same conditions, the prior art metering notch acted largely as a direct "short circuit" from the inlet port to the outlet port. It should also be noted that, with the invention, the leakage fluid during load-holding flows through the lubrication flow path described previously, which offers substantial restriction to flow, whereas the leakage flow through the prior art metering notch merely flows through the outlet port to the system reservoir, encountering almost no resistance to flow.

In utilizing the present invention, it is believed to be easily within the ability of one skilled in the art to dimension the various spaces and recesses shown in FIG. 4 in order to obtain sufficient lubrication flow from the volume chambers (e.g., 0.5 gpm), while still having sufficient restriction (or resistance) to leakage (lubrication) flow to maintain the desired, overall efficiency of the motor. For example, in the motor of the type shown in FIG. 1 which is sold commercially by the assignee of the present invention, each of the side clearance spaces 85 (at each end of each roller 25) is relatively small, but is shown greatly exaggerated for ease of illustration.

Another factor to be considered in utilizing the present invention is the depth and area of each of the lubricant recesses 81. By "area" is meant primarily the area of roller "exposure" to the recess 81, i.e., the area of overlap of the roller 25 and recess 81, as best shown in FIG. 3. The optimum area of exposure, for any given gerotor and motor design can be very easily determined, starting with minimum area of exposure and measuring lubricant flow rate and overall motor performance, then machining the surface 77 to increase the area of exposure of the recess 81, and again measuring motor performance and lubrication flow rate.

Although the present invention has been illustrated and described in connection with a roller gerotor 17, the invention could also be applied to a motor using a standard gerotor in which the internal teeth are integral with the ring member 23. In this case, there are no side clearance spaces 85 which inherently result from the rollers 25 being shorter axially than the ring member 23. Instead, with a standard gerotor, it is necessary to create the necessary side clearance spaces on each axial end of each of the teeth by means of lapping, grinding, etc.

The invention has been described in detail sufficient to enable one skilled in the art to make and use the same. It is believed that certain alterations and modifications of the invention will become apparent to those skilled in the art upon a reading and understanding of the specification, and it is intended to include all such alterations and modifications as part of the invention, insofar as they come within the scope of the appended claims.

I claim:

1. A rotary fluid pressure device of the type including housing means defining fluid inlet means and fluid outlet means; a gerotor gear set associated with said housing means and including an internally-toothed ring member, and an externally-toothed star member eccentrically disposed within sand ring member for relative orbital and rotational movement therein, said ring member defining a plurality of internal teeth, said internal teeth and the teeth of said star member interengaging to define expanding and contracting fluid volume chambers during said movement of said star member; valve means providing fluid communication between said fluid inlet means and said expanding volume chambers and between said contracting volume chambers and said fluid outlet means; input-output shaft means and main drive shaft means operable to transmit said rotational movement between one of said toothed members having rotational movement and said input-output shaft means; said main drive shaft means cooperating with said one of said toothed members to define first tongue transmitting drive means and cooperating with said input-output shaft means to define second torque transmitting drive means; means defining a lubrication flow path including said first and second torque transmitting drive means and means providing a generally continuous flow of lubrication fluid to said lubrication flow path, characterized by:

(a) said lubrication fluid providing means comprising each of said internal teeth including an axial end surface, said end surfaces cooperating with a first adjacent end surface of said housing means to define a first plurality of side clearance spaces, said first adjacent end surface defining a plurality of lubricant recesses, each of said recesses having a substantially greater axial extent than said clearance spaces and being disposed adjacent the radially outermost portion of said axial end surfaces of said respective internal teeth said side clearance spaces and said plurality of lubricant recesses providing fluid communication between said fluid volume chambers and said lubrication flow path.

2. A rotary fluid pressure device as claimed in claim 1 characterized by said ring member defining a plurality of semi-cylindrical pockets and a cylindrical roller disposed in each of said pockets, said rollers comprising said internal teeth, each of said rollers having slightly less axial length than said ring member to define said first plurality of side clearance spaces.

3. A rotary fluid pressure device as claimed in claim 2 characterized by each of said cylindrical rollers including an opposite axial end surface, said opposite end surfaces cooperating with a second adjacent end surface of said housing means to define a second plurality of side clearance spaces, said second side clearance spaces providing fluid communication between said fluid volume chambers and said lubrication flow path.

4. A rotary fluid pressure device as claimed in claim 1 characterized by said first adjacent end surface of said housing. means defining a generally annular fluid-collecting groove disposed radially outwardly from said cylindrical rollers, said groove being in fluid communication with each of said first plurality of side clearance spaces.

5. A rotary fluid pressure device as claimed in claim 4 characterized by each of said lubricant recesses being disposed in fluid communication with said fluid collecting groove.

6. A rotary fluid pressure device as claimed in claim 1 characterized by bearing means disposed radially between said input-output shaft means and said housing means to support said shaft means for rotation relative to said housing means, said lubrication flow path including said bearing means.

7. A rotary fluid pressure device as claimed in claim 6 characterized by said bearing means comprising first and second axially spaced apart bearing sets and said lubrication flow path includes flow through said first and second bearing sets in series.

8. A rotary fluid pressure device as claimed in claim 1 characterized by said star member and said input-output shaft means defining first and second sets of internal splines, respectively, and said main drive shaft means defining first and second axially spaced apart sets of external splines, said first sets of internal and external splines comprising said first drive means and said second sets of internal and external splines comprising said second drive means.

9. A rotary fluid pressure device of the type including housing means defining fluid inlet means and fluid outlet means; fluid energy-translating displacement means associated with said housing means and including an internally-toothed member, and an externally-toothed member eccentrically disposed within said internally-toothed member for relative orbital and rotational movement therebetween, the teeth of said members interengaging to define expanding and contracting fluid volume chambers during said relative movement, one of said members having rotational movement about its own axis, and one of said members having orbital movement about the axis of the other of said members; valve means providing fluid communication between said fluid inlet means and said expanding volume chambers and between said contracting volume chambers and said fluid outlet means; input-output shaft means and bearing means disposed radially between said input-output shaft means and said housing means to support said shaft means for rotation relative to said housing means; main drive shaft means operable to transmit said rotational movement between said one of said toothed members and said input-output shaft means, said main drive shaft means cooperating with said one of said toothed members to define first torque transmitting drive means and cooperating with said input-output shaft means to define second torque transmitting drive means; means defining a lubrication flow path including said first and second torque transmitting drive means and said bearing means, characterized by:

(a) said fluid energy-translating displacement means including means providing a generally continuous flow of lubrication fluid from at least a portion of said fluid volume chambers to said lubrication flow path;

(b) said lubrication flow path comprising, in the order indicated:

(i) flow through said bearing means;

(ii) flow through said second torque transmitting connection means; and (iii) flow through said first torque transmitting connection means; and (c) said rotary fluid pressure device defining drain passage means communicating said flow of lubrication fluid from said lubrication flow path to one of said fluid outlet means and a separate case drain outlet port.

10. A rotary fluid pressure device as claimed in claim 9 characterized by said lubrication flow path further comprising flow through passage means defined by said input-output shaft means, after said flow through said bearing means.

11. A rotary fluid pressure device as claimed in claim 9 characterized by said bearing means comprising first and second axially spaced apart bearing sets and said flow through said bearing means is through said first and second bearing sets in series.

12. A rotary fluid pressure device as claimed in claim 9 characterized by said one of said toothed members having rotational movement comprising said externally-toothed member, said externally-toothed member and said input-output shaft means defining first and second sets of internal splines, respectively, and said main drive shaft means defining first and second axially spaced apart sets of external splines, said first sets of internal and external splines comprising said first drive means and said second sets of internal and external splines comprising said second drive means.

13. A rotary fluid pressure device as claimed in claim 9 characterized by said valve means including a rotary valve member defining valve passage means and said rotary valve member and said toothed member having rotational movement defining internal splines, and a valve drive shaft defining external splines in engagement with both said internal splines to drive said rotary valve member in synchronism with said rotational movement; said lubrication flow path further comprising:

(iv) flow through said external splines defined by said valve drive shaft and said engaging internal splines.

14. A rotary fluid pressure device as claimed in claim 13 characterized by said drain passage means includes a passage defined by said rotary valve member.

15. A rotary fluid pressure device as claimed in claim 9 characterized by said means providing said flow of lubrication fluid including a first plurality of side clearance spaces defined by an axial end surface of said internally-toothed member and an adjacent end surface of said housing means.

16. A rotary fluid pressure device as claimed in claim 15 characterized by a second plurality of said side clearance spaces at the opposite axial end of said internally-toothed member, said first and second pluralities of said side clearance spaces being in fluid communication with each other.

17. A rotary fluid pressure device as claimed in claim 9 characterized by said fluid energy-translating displacement mechanism comprising a gerotor gear set including an internally-toothed ring member fixed relative to said housing means, and an externally-toothed star member eccentrically disposed within said ring member for orbital and rotational movement therein.

18. A rotary fluid pressure device as claimed in claim 17 characterized by said ring member defining a plurality of semi-cylindrical pockets and said internal teeth comprising a plurality of cylindrical rollers, each of said rollers being disposed in one of said pockets, each of said rollers having slightly less axial length than said ring member to define a side clearance space at each axial end of each roller, said means providing said flow of lubrication fluid comprising said side clearance spaces.

19. A rotary fluid pressure device of the type including housing means defining fluid inlet means and fluid outlet means; a gerotor gear set associated with said housing means and including an internally-toothed ring member, and an externally-toothed star member eccentrically disposed within said ring member for relative orbital and rotational movement therein, said ring member defining a plurality of semi-cylindrical pockets and a cylindrical roller disposed in each of said pockets, said rollers and the teeth of said star member interengaging to define expanding and contracting fluid volume chambers during said movement of said star member; valve means providing fluid communication between said fluid inlet means and said expanding volume chambers and between said contracting volume chambers and said fluid outlet means; an output shaft and a pair of axially spaced apart bearing sets disposed radially between said output shaft and said housing means to support said shaft for rotation relative to said housing means; a main drive shaft operable to transmit said rotational movement of said star member to said output shaft, said main drive shaft cooperating with said star member to define a first torque transmitting spline coupling and cooperating with said output shaft to define a second torque transmitting spline coupling; means defining a lubrication flow path including said first and second torque transmitting spline couplings and said first and second bearing sets, characterized by:

(a) said gerotor gear set including means providing a generally continuous flow of lubrication fluid from the expanding volume chambers to said lubrication flow path, said lubrication flow providing means comprising side clearance spaces defined by each of said rollers;

(b) said lubrication flow path comprising in the order indicated:

(i) flow through said first and second bearing sets;

(ii) flow through said second torque transmitting spline coupling; and (iii) flow through said first torque transmitting spline coupling; and (c) said rotary fluid pressure device defining drain passage means communicating said flow of lubrication fluid from said lubrication flow path to one of said fluid outlet means and a separate case drain outlet port.

* * * * *